US005998360A

United States Patent [19]

Cockett et al.

[11] Patent Number: 5,998,360

[45] Date of Patent: Dec. 7, 1999

[54] GRANULES BASED ON SILICATE ANTIREDEPOSITION AGENT MIXTURES AND METHOD FOR MANUFACTURING SAME

[75] Inventors: Keith R Cockett, Warrington, United Kingdom; Theo J Osinga, Cadier en Keer, Netherlands

[73] Assignee: Crosfield Limited, Warrington, United Kingdom

[21] Appl. No.: 08/809,559

[22] PCT Filed: Aug. 29, 1995

[86] PCT No.: PCT/EP95/03396

§ 371 Date: Apr. 13, 1998

§ 102(e) Date: Apr. 13, 1998

[87] PCT Pub. No.: WO96/09367

PCT Pub. Date: Mar. 28, 1996

[30] Foreign Application Priority Data

Sep. 22, 1994 [EP] European Pat. Off. ..... 94306953

[51] Int. Cl.[6] ..... C11D 3/08; C11D 3/37; C11D 3/395; C11D 11/00

[52] U.S. Cl. ..... 510/528; 510/229; 510/230; 510/299; 510/318; 510/349; 510/361; 510/367; 510/400; 510/438; 510/441; 510/442; 510/443; 510/452; 510/476; 510/477; 510/511

[58] Field of Search ..... 510/528, 511, 510/299, 318, 334, 349, 400, 438, 441, 442, 443, 452, 476, 361, 507, 533, 229, 230, 367, 477; 252/FOR 160

[56] References Cited

U.S. PATENT DOCUMENTS

| | | | |
|---|---|---|---|
| 3,284,364 | 11/1966 | Siegele | 252/132 |
| 3,285,859 | 11/1966 | Jelen | 252/385 |
| 3,450,494 | 6/1969 | Gaiser | 423/332 |
| 3,615,779 | 10/1971 | Von Freyhold | 106/630 |
| 3,654,168 | 4/1972 | Gaiser | 510/276 |
| 3,674,700 | 7/1972 | Gaiser | 510/298 |
| 3,764,356 | 10/1973 | Sams | 106/634 |
| 3,849,327 | 11/1974 | DiSalvo et al. | 252/109 |
| 4,006,110 | 2/1977 | Kenney et al. | 510/349 |
| 4,022,704 | 5/1977 | Balfanz et al. | 510/531 |
| 4,200,548 | 4/1980 | Sunden et al. | 510/337 |
| 4,844,831 | 7/1989 | Joubert et al. | 510/299 |
| 4,988,454 | 1/1991 | Eertink et al. | 510/443 |
| 5,066,415 | 11/1991 | Dany | 252/135 |
| 5,393,455 | 2/1995 | Poethkow et al. | 510/476 |
| 5,496,495 | 3/1996 | Beck et al. | 510/361 |
| 5,575,946 | 11/1996 | Beck et al. | 252/181 |
| 5,703,031 | 12/1997 | Trani et al. | 510/312 |

FOREIGN PATENT DOCUMENTS

| | | | |
|---|---|---|---|
| 0 285 480 | 10/1988 | European Pat. Off. | C11D 3/08 |
| 0 445 852 | 9/1991 | European Pat. Off. . | |
| 2 360 661 | 3/1978 | France | C11D 3/02 |
| 2 036 673 | 2/1971 | Germany | C11D 3/08 |
| 93/25651 | 12/1993 | WIPO . | |

*Primary Examiner*—Ardith Hertzog
*Attorney, Agent, or Firm*—Pillsbury Madison & Sutro Intellectual Property Group

[57] ABSTRACT

Soluble alkali metal silicates combined with antiredeposition agents can actually have a beneficial effect on bleach stabilisation if said antiredeposition agents are intimately mixed with an alkali metal silicate solution, the resulting product being then dried (spray drying, turbo drying, etc . . . ) into granules.

29 Claims, 3 Drawing Sheets

GRANULES BASED ON SILICATE ANTIREDEPOSITION AGENT MIXTURES AND METHOD FOR MANUFACTURING SAME

This application is the national phase of international application PCT/EP95/03396 filed Aug. 29, 1995 which designated the U.S.

FIELD OF THE INVENTION

The present invention relates to new alkali metal silicate granules. The present invention also relates to a method of manufacturing said granules.

BACKGROUND OF THE INVENTION

Alkali metal silicates, and more particularly sodium silicates, are commonly used in detergents compositions such as washing and dishwashing compositions.

Dishwashing powders generally consist of dry mixed granular components having a particle size between 200 and 2000 micrometers, preferably between 300 and 1000 micrometers. Although most fabric washing powders were produced by spray-drying a liquid mixture (slurry), including alkali metal silicate in liquid form, developments towards phosphate-free- and higher density powders have increasingly led to a change in processing to produce these fabric washing detergent powders, i.e.: Either towards a complete dry-mixing of all components in granular form or by spray drying only part of the components followed by post-dosing of the remaining components in granular form. The alkali metal silicate is preferably post-dosed in granular form in this process as well.

Alkali metal silicates used in detergents are preferably sodiumsilicates having molar ratios $SiO_2/Na_2O$ varying between 1.0 (Sodium metasilicate used in machine dishwashing products) and 3.4. Generally preferred molar ratios ($SiO_2/Na_2O$) for modern machine dish washing and fabric washing powders being between 2.0 and 2.4.

Many formulations for dishwashing as well as for fabric washing contain bleach components which are based on peroxide. For detergent powder formulations, alkalimetal salts of perborate and percarbonate are generally preferred either alone or in combination with bleach promoters (e.g.: TAED, i.e.: tetraacetylethylenediamine).

In washing compositions, it is known, for example from WO92/03525, that heavy metals present can catalytically decompose peroxide bleach systems in the presence of water, e.g.: during the washing process. The heavy metal ions are either present in the washgoods (dirt/stains) or in the raw materials used for the detergent powder. It is also known that alkali metal silicates can bind heavy metals and have thus a positive effect on bleach stabilisation. However, during each washing cycle, part of said alkali metal silicates which have absorbed heavy metals, precipitates on the textile fibres, leading to a deposit on the cloth, which increases during each subsequent wash cycle. This heavy metal silicate gives rise to local decomposition of the bleach and to textile strength loss as well as to dye damage. This phenomenon has been for example disclosed in WO92/03525 pages 38–39. It is known that antiredeposition agents, such as certain polymers or copolymers, can in some circumstances prevent deposition of metal silicates.

Nevertheless, WO92/03525 has shown that adding such polymers has little effect on bleach stability and textile strength in presence of silicates (comparative example E).

Thus there is a need for a soluble alkali metal silicate in a granular form which can be added to bleach containing detergent compositions for its heavy metals sequestering capacity and which does not cause deposition of silicates onto the fabrics.

Turning to dishwashing compositions silicate compounds inhibit corrosion on glass while acting as alkali generating agents. Now, while being very active in such compositions, said compounds, specifically metasilicates, can be particularly dangerous when ingested by young children. Less alkalinity with a comparable level of protection against corrosion can be achieved by using sodium silicates with higher $SiO_2$:$Na_2O$ molar ratios, e.g. disilicates ($SiO_2/Na_2O$ molar ratio: 2.0). Nevertheless such products are still hazardous and more and more national legislations are requiring to further limit the alkalinity of the mechanical dishwashing compositions, something which is normally achieved by decreasing the volume of alkali metal silicate in the composition since the alternative of using alkali metal silicates with a molar ratio of more than 2.4 is not practical due to the poor dissolution properties of such a product.

In fabric washing powders, soluble alkali metal silicate with a molar ratio ($SiO_2/Na_2O$) of 2.0 is generally used and although the quantity of silicate used in fabric washing powders is generally much lower (e.g.: 2–7%) alkalinity is also becoming an issue in these products, also containing other alkaline components.

There is therefore a need for a soluble alkali metal silicate in a granular form which can be added in increasing amounts to detergent compositions without increasing the pH.

GENERAL DESCRIPTION OF THE INVENTION

Now it has been discovered that soluble alkali metal silicates combined with antiredeposition agents can actually have a beneficial effect on bleach stabilisation, contrary to the prior art teaching, if said antiredeposition agents are intimately mixed with an alkali metal silicate solution, the resulting product being then dried (spray dying, turbo drying, etc . . . ) into granules.

It is therefore a first object of the present invention to provide a process for manufacturing silicate granules wherein antiredeposition agents are intimately mixed with an alkali metal silicate solution to produce a slurry comprising 50 to 99% w/w (on dry basis) of soluble alkali metal silicate and 1 to 50% w/w (on dry basis) of an antiredeposition agent, the resulting slurry being then dried to a water content of less than 25% w/w.

Preferably, the slurry contains 80 to 98% w/w (on dry basis) of soluble alkali metal silicate and 2 to 20% w/w (on dry basis) of an antiredeposition agent.

It has been discovered that drying at a water content of more than 25% was indeed not a practical solution due to caking of the powder or the granules obtained and 22% was indeed chosen as the preferable upper limit. On the other hand drying to a water content of less than 15%, although feasible, is not suitable for modern detergent products, because it excessively reduces the rate of dissolution of the granules at lower temperatures as commonly applied in the washing processes. Therefore, the end product has preferably a water content of between 15% and 22% w/w.

The drying step can be realised by spray drying or turbo drying followed by compaction, the granulation can also be realised in a VOMM granulator (VOMM IMPIANTI E PROCESSI S.r.l., Milan, Italy).

By antiredeposition agents it is understood products such as derivatives of amino (lower alkaline) acetic acids for example ethylene diamine tetraacetic acid (EDTA), diethylene triamine penta methylene phosphonic acid (DTMP) and diethylene triamine pentaacetic acid (DTPA), or from homopolymer of (meth)acrylic acid or copolymer of acrylic acid with methacrylic acid (meth) acrylamide, (meth) acrylate esters and the copolymer of maleic acid with styrene or a vinyl ester of vinyl ether, or mixtures thereof.

It is a second object of the present invention to provide alkali metal silicate granules comprising 50 to 99% w/w (on dry basis) of soluble alkali metal silicate and 1 to 50% w/w (on dry basis) of an antiredeposition agent, the soluble alkali metal silicate and the antiredeposition agent being homogeneously distributed in the granules.

Preferably, the alkali metal silicate granules comprise 80 to 98% w/w (on dry basis) of alkali metal silicate and 2 to 20% w/w (on dry basis) of an antiredeposition agent.

Now, it has been discovered that said granules have a poor dissolution rate since while they dissolve almost completely (above 99%), the dissolution is very slow. Nevertheless quick dissolution is essential in order to have the silicate/antiredeposition agent in solution when the bleach present in the solid detergent product dissolves in the washing bath in order to entrap heavy metals and to avoid the deposition of alkali metal silicate having absorbed said heavy metals onto the fabrics. Otherwise the bleach will not be protected from its catalytic decomposition triggered by heavy metals.

Now, it has been discovered that, while the mere addition of solid acid particles to the granules does not improve the dissolution of said granules, the incorporation of solid acid particles to the alkali metal silicate granules leading to alkali metal silicate/acid co-granules provides faster dissolution of said granules. Moreover, it enables the pH is be kept below a certain value whereas high pH has a negative effect on bleach stability and textile strength as well as on dye damage. This addition can be realised by mixing together solid acid particles and silicate/polymer particles and then compacting the blend in a compactor.

For the compaction process it is advantageous to use powder particles having a particle size below approx. 300 microns. For detergent applications it is generally required to produce granular particles of a particle size between 200 micrometer and 1200 micrometer and preferably between 300 micrometer and 1000 micrometer.

Although it was expected that it would not be possible to mix powder particles of a highly alkaline compound like alkali metal silicate and of an acid and compact this mixture at high pressure, since such compaction would increase temperature would give rise to a surface reaction between the particles, it was found that this is practically not the case.

In a separate series of experiments water (approx. 2% by weight) was sprayed into the mixer in which the silicate/polymer powder was mixed with citric acid powder (10% by weight, 30% by weight and 50% by weight) before compaction in order to assess whether this would cause a reaction between the acid and the silicate producing insoluble silica. It was again found, that this was practically not the case. It was observed however, that the strength of the granules produced improved, without influencing the solubility.

It is a third object of the present invention to provide alkali metal silicate granules comprising 49 to 94% w/w (on dry basis) of alkali metal silicate and 1 to 46% w/w (on dry basis) of an antiredeposition agent, the alkali metal silicate and the antiredeposition agent being homogeneously distributed in the granules, further comprising 5 to 50% w/w (on dry basis) of acid, preferably 20 to 50% w/w.

SPECIFIC DESCRIPTION OF THE INVENTION

BRIEF DESCRIPTION OF THE DRAWINGS

The present invention will be further described in the following examples with reference to FIGS. 1, 2 and 3 which represent under washing conditions, the influence of the granules according to the present invention on the pH of the washing liquor.

EXAMPLE 1

Figure 1:
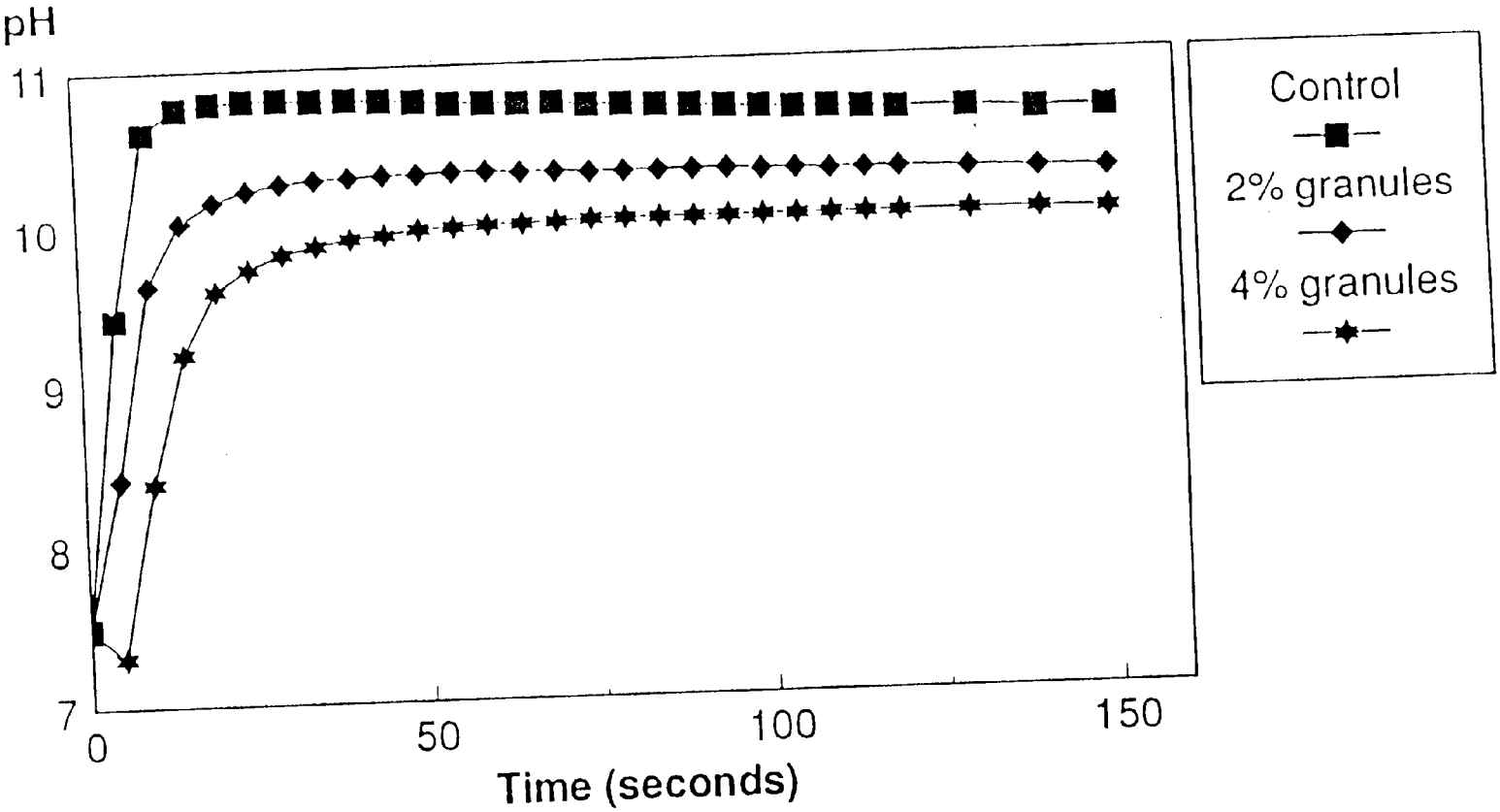

Granules of alkali metal silicate and antiredeposition agent having the following composition:

6.1 wt. % Alcosperse 175 (an antiredeposition agent obtainable from National Starch and Chemical Company, 10 Finderne Avenue, Bridgewater, N.J., USA)

73.9 wt. % Sodiumdisilicate (Mol. Ratio $SiO_2/Na_2O$:2.0)

20 wt. % water were produced according to the following process:

90 kg. of an aqueous solution of Sodiumdisilicate containing 47% by weight of Sodiumdisilicate was mixed intensively during 1 hour at 60° C. with 10 kg. of an aqueous solution of Alcosperse 175 containing 40% by weight of Alcosperse. The mixture obtained was simultaneously dried and granulated in a VOMM Turbo-Granulator dryer as described n EP-A-0 526 978. The outlet temperature of the air being approx. 120° C.

The required fraction with a particle size of 200–1000 micrometer was separated by sieving, while the oversize fraction was milled and recycled over the sieve. The fines obtained were used in Example 2.

EXAMPLE 2

The influence of acid addition on dissolution and pH was then tested.

The granules obtained in Example 1 were milled down to a particle size below 300 micrometer and mixed with the fines obtained in Example 1 and with anhydrous citric acid powder to produce following samples (varying wt. % citric acid):

0% (control); 10%; 20%; 25%; 30%; 50%.

All these mixtures were compacted and grinded to the right particle size and sieved producing excellent quality granules with very good dissolution properties compared to the corresponding granules of the same silicate/Alcosperse mixture without citric acid (control) having a dissolution time of 3–8 minutes.

The silicate/Alcosperse powder mixture used in the direct comparison test, compacted and grinded and sieved to the same particle size (control) had a dissolution time of 7 minutes.

The dissolution time to achieve practically complete dissolution (>99%) at 20° C. under stirring for the granules produced containing citric acid was between 20 (10% citric acid) and 60 seconds (50% citric acid). It was therefore surprisingly found that there is an optimum acid content when it turns to dissolution speed since, on the one hand, at 0% the dissolution is very slow and, on the other hand, the dissolution speed is decreasing from 10% acid to 50% acid.

In a first test series all granular samples were dissolved in demineralised water at a concentration of 2.5 g./l. (2.5 g. on basis: (Disilicate+Alcosperse). The citric acid was treated as additional.

| Wt. % Citric. | pH 0 | pH 10 | pH 20 | pH 25 | pH 30 | pH 50 |
|---|---|---|---|---|---|---|
| Sec. | | | | | | |
| 0 | 7.4 | 7.4 | 6.4 | 7.3 | 7.2 | 7.3 |
| 5 | 10.1 | 9.1 | 6.84 | 6.0 | 5.4 | 3.2 |
| 10 | 11.3 | 11.1 | 7.29 | 6.4 | 5.2 | 3.0 |
| 15 | 11.4 | 11.1 | 7.96 | 7.98 | 5.3 | 3.1 |
| 20 | 11.5 | 11.07 | 8.97 | 8.88 | 5.5 | 3.2 |
| 30 | 11.5 | 11.0 | 9.56 | 9.45 | 5.9 | 3.4 |
| 40 | 11.5 | 10.94 | 9.74 | 9.58 | 6.3 | 3.5 |
| 60 | 11.34 | 10.86 | 9.83 | 9.62 | 6.8 | 3.7 |
| 100 | 11.13 | 10.82 | 9.84 | 9.63 | 7.4 | 3.8 |
| 150 | 11.03 | 10.79 | 9.82 | 9.63 | 7.7 | 3.9 |
| 200 | 10.97 | 10.77 | 9.82 | 9.63 | 7.7 | 3.9 |

The control sample (0% citric acid) was still not dissolved completely after 3 minutes as could be seen from independent measurements of the electrical conductivity. The slow reduction of pH after 1 minute of the most alkaline liquors, may be caused by a reaction between polymerised silicate with these more alkaline liquors.

It is clearly demonstrated, that depending on the citric acid level, that the pH of the solution obtained can be controlled between a pH of around 11 and lower than 5.

It is clear from this that addition of a 30% citric acid containing co-granule to an alkaline wash liquor will not lead to an increase of the pH.

Addition of a 50% citric acid containing co-granule to a wash powder could even reduce the pH obtained in the wash.

This has been investigated separately.

We used Persil Megaperls, Dash Ultra and Ariel Ultra (commercially available) as base detergents composition to which different levels of cogranules were added (0%—Control, 2% and 4%). Addition levels of Co-granule were expressed as wt. % on basis mixture Silicate/Alcosperse. The citric acid was treated as coming along within the co-granule. To mimic washing conditions the detergent composition were dosed to demineralised water at 12.5 g./1. detergent composition.

Figure 2:
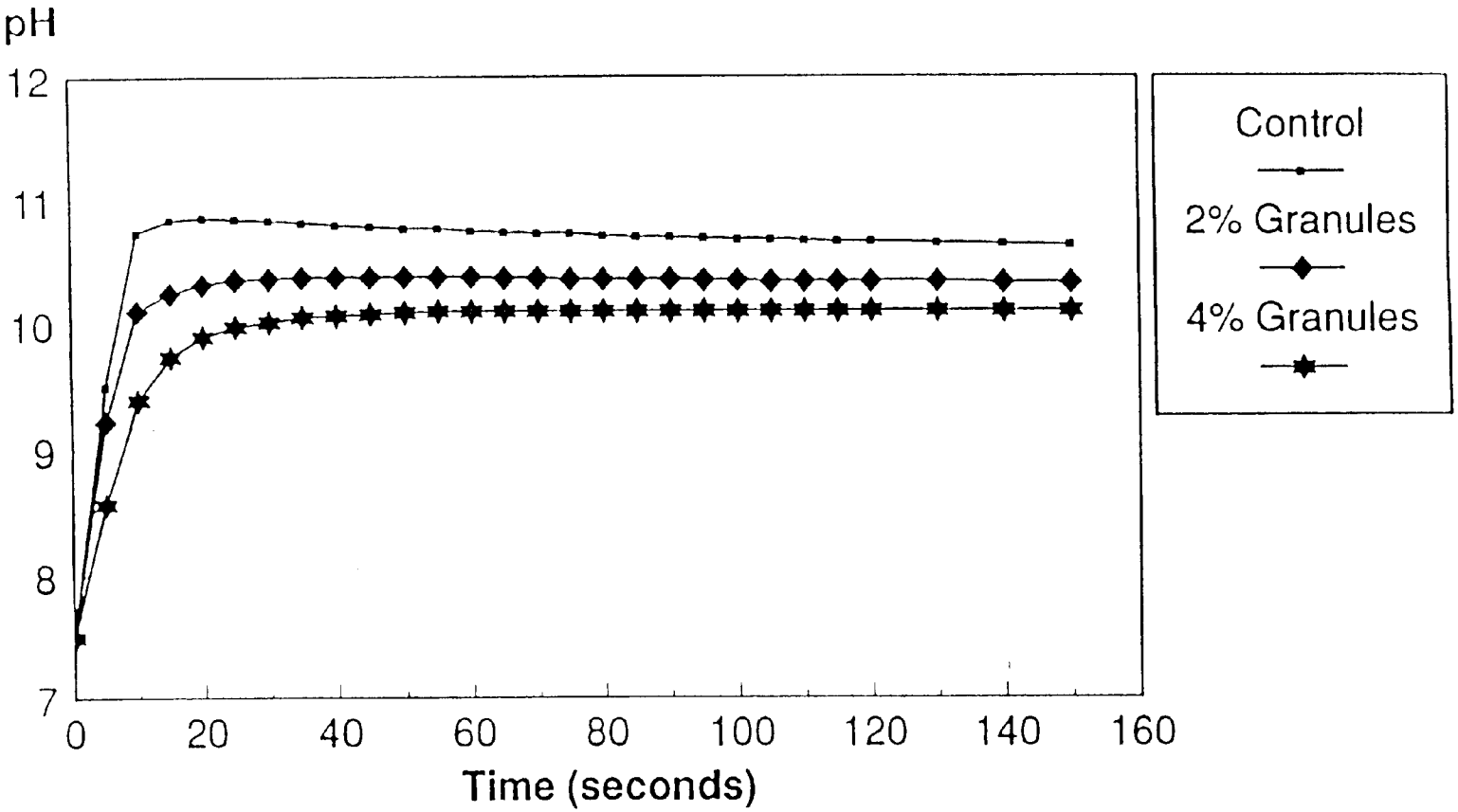
Figure 3:
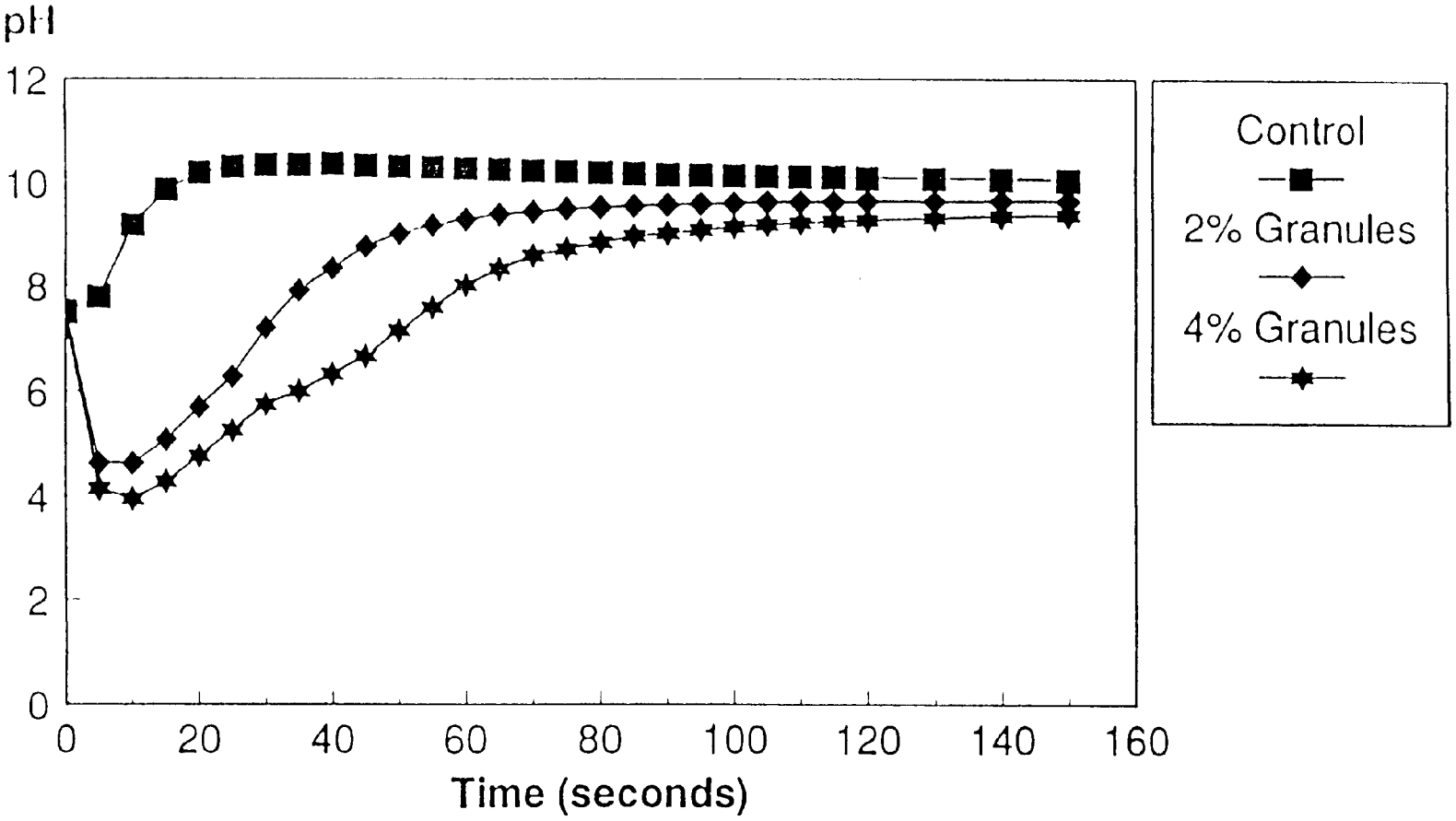

The results are summarised on FIG. 1 (Dash Ultra), FIG. 2 (Ariel Ultra) and FIG. 3 (Persil Megaperls).

It is clear that the cogranules of the invention also reduce the pH in the wash.

We claim:

1. Process for manufacturing silicate granules wherein an organic antiredeposition agent is intimately mixed with an alkali metal silicate solution to produce a mixture comprising 50 to 99% w/w, on a dry basis, of soluble alkali metal silicate and 1 to 50% w/w, on a dry basis, of the organic antiredeposition agent, the resulting mixture being then dried by spray drying or turbo drying to a water content of at least 15% but less than 25% w/w and wherein the alkali metal silicate and the antiredeposition agent are homogeneously distributed in the dried mixture.

2. The process according to claim 1 wherein the mixture contains 80 to 98% w/w, on a dry basis, of soluble alkali metal silicate and 2 to 20% w/w, on a dry basis, of the antiredeposition agent.

3. The process according to claim 1 wherein the resulting mixture is dried to a water content of between 15% and 22% w/w.

4. The process as claimed in claim 1 wherein the alkali metal is sodium and the molar ratio, $SiO_2/Na_2O$, of the alkali metal silicate is between 2.0 and 3.4.

5. The process as claimed in claim 1 in which the alkali metal is sodium and the molar ratio, $SiO_2/Na_2O$, of the alkali metal silicate is between 2.0 and 2.4.

6. The process as claimed in claim 1 wherein the antiredeposition agent is polymeric.

7. The process as claimed in claim 1 wherein the granules have a particle size between 200 and 1200 microns.

8. The process as claimed in claim 1 wherein the dried mixture is combined with particles of acid and processed to form co-granules containing 49 to 94% w/w, on a dry basis, of alkali metal silicate, 1 to 46% w/w, on a dry basis, of the organic antiredeposition agent, and 5 to 50% w/w, on a dry basis, of acid in particle form.

9. The process as claimed in claim 8 wherein the acid comprises from 20 to 50% w/w, on dry basis, of the co-granules.

10. The process as claimed in claim 8 wherein the acid comprises citric acid.

11. The process as claimed in claim 1 further comprising the step of combining the dried mixture of alkali metal silicate and organic antiredeposition agent with solid acid particles to form co-granules containing said alkali metal silicate, said antiredeposition agent and said acid.

12. The process as claimed in claim 11 wherein the acid comprises citric acid.

13. Alkali metal silicate granules comprising 49 to 94% w/w, on a dry basis, of alkali metal silicate and 1 to 46% w/w, on a dry basis, of an organic antiredeposition agent, the alkali metal silicate and the antiredeposition agent being homogeneously distributed in the granules, further comprising 5 to 50% w/w, on a dry basis, of acid in particle form.

14. Alkali metal granules as claimed in claim 13 having a water content in the range of 15 to 25% w/w.

15. Alkali metal granules as claimed in claim 13 having a water content of between 15% and 22% w/w.

16. Alkali metal silicate granules as claimed in claim 13 wherein the alkali metal is sodium and the molar ratio, $SiO_2/Na_2O$, of the alkali metal silicate is between 2.0 and 3.4.

17. Alkali metal silicate granules as claimed in claim 13 wherein the alkali metal is sodium and the molar ratio, $SiO_2/Na_2O$, of the alkali metal silicate is between 2.0 and 2.4.

18. A detergent composition containing alkali metal granules as claimed in claim 13.

19. A bleach-containing detergent composition containing alkali metal granules as claimed in claim 13.

20. Alkali metal silicate granules as claimed in claim 13 wherein the granules have a particle size between 200 and 1200 microns.

21. Alkali metal silicate granules as claimed in claim 13 wherein the granules have a particle size between 300 and 1000 microns.

22. Alkali metal silicate granules as claimed in claim 13 wherein said acid comprises from 20 to 50% w/w, on a dry basis, of the granules.

23. Alkali metal granules as claimed in claim 22 wherein the acid comprises particles of citric acid.

24. Alkali metal silicate granules comprising 49 to 94% w/w, on a dry basis, of alkali metal silicate, 1 to 46% w/w, on a dry basis, of an organic antiredeposition agent, and 5 to 50% w/w, on a dry basis, of acid in particle form, wherein the granules comprise particles containing the alkali metal silicate and the antiredeposition agent combined with particles of the acid, the alkali metal silicate and the antiredeposition agent being homogeneously distributed in the said particles containing the silicate and the antiredeposition agent.

25. Alkali metal silicate granules as claimed in claim 24 having a water content of between 15 and 22% w/w.

26. A detergent composition containing alkali metal granules as claimed in claim 24.

27. A bleach-containing detergent composition containing alkali metal granules as claimed in claim 24.

28. Alkali metal silicate granules as claimed in claim 24 wherein the granules have a particle size between 200 and 1200 microns.

29. Alkali metal silicate granules as claimed in claim 24 wherein the granules have a particle size between 300 and 1000 microns.

* * * * *